US006820971B2

(12) United States Patent
Tang et al.

(10) Patent No.: US 6,820,971 B2
(45) Date of Patent: Nov. 23, 2004

(54) METHOD OF CONTROLLING HEATERS IN A CONTINUOUS INK JET PRINT HEAD HAVING SEGMENTED HEATERS TO PREVENT TERMINAL INK DROP MISDIRECTION

(75) Inventors: Manh Tang, Penfield, NY (US); David A. Johnson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 142 days.

(21) Appl. No.: 10/172,429

(22) Filed: Jun. 14, 2002

(65) Prior Publication Data

US 2003/0234836 A1 Dec. 25, 2003

(51) Int. Cl.[7] ..... B41J 2/12
(52) U.S. Cl. ..... 347/78
(58) Field of Search ..... 347/77, 78, 73–75, 347/79, 82, 20

(56) References Cited

U.S. PATENT DOCUMENTS

| | | | | |
|---|---|---|---|---|
| 4,621,271 A | | 11/1986 | Brownstein | 347/211 |
| 4,951,152 A | | 8/1990 | Suzuki et al. | 347/184 |
| 4,994,822 A | | 2/1991 | Caine | 347/209 |
| 5,321,427 A | | 6/1994 | Agar et al. | 347/183 |
| 5,481,288 A | * | 1/1996 | Keeling et al. | 347/80 |
| 6,079,821 A | | 6/2000 | Chwalek et al. | 347/82 |
| 6,254,225 B1 | | 7/2001 | Chwalek et al. | 347/82 |
| 6,382,782 B1 | | 5/2002 | Anagnostopoulos et al. | |
| 6,447,108 B1 | * | 9/2002 | Kassner | 347/80 |

FOREIGN PATENT DOCUMENTS

EP 1193066 A1 4/2002

* cited by examiner

*Primary Examiner*—K. Feggins
(74) *Attorney, Agent, or Firm*—William R. Zimmerli

(57) ABSTRACT

A method for timing a deflection correcting electrical pulse relative to operational pulses of an asymmetric thermal droplet deflector of a continuous ink jet printer having nozzles, including the steps of generating a line image data with image data values corresponding to the nozzles, the image data values being indicative of desired pixel graytone levels for the nozzles, comparing the image data values to reference values, generating a serial bit stream in the form of a serially arranged bits based on the comparison of the image data values to the reference values, and producing an actuation value that times the deflection correcting electrical pulse in the serial bit stream when the image data value is equal to the reference value being compared to. The deflection correcting electrical pulse is timed to the actuation value in the serial bit stream.

28 Claims, 14 Drawing Sheets

| FIRST LINE IMAGE DATA | | | | |
|---|---|---|---|---|
| IMAGE DATA =2 (1ST NOZZLE) | IMAGE DATA =5 (2ND NOZZLE) | IMAGE DATA =0 (3RD NOZZLE) | IMAGE DATA =1 (4TH NOZZLE) | |
| 1 | 1 | 0 | 1 | FIRST SERIAL BIT STREAM TO BE SHIFTED |
| 1 | 1 | 0 | 0 | SECOND SERIAL BIT STREAM TO BE SHIFTED |
| 0 | 1 | 0 | 0 | THIRD SERIAL BIT STREAM TO BE SHIFTED |
| 0 | 1 | 0 | 0 | FOURTH SERIAL BIT STREAM TO BE SHIFTED |
| 0 | 1 | 0 | 0 | FIFTH SERIAL BIT STREAM TO BE SHIFTED |
| 0 | 0 | 0 | 0 | SIXTH SERIAL BIT STREAM TO BE SHIFTED |
| 0 | 0 | 0 | 0 | SEVENTH SERIAL BIT STREAM TO BE SHIFTED |

A

A

FIG. 5A

Ⓐ

| SECOND LINE IMAGE DATA | | | | |
|---|---|---|---|---|
| IMAGE DATA =7 (1ST NOZZLE) | IMAGE DATA =3 (2ND NOZZLE) | IMAGE DATA =4 (3RD NOZZLE) | IMAGE DATA =6 (4TH NOZZLE) | |
| 1 | 1 | 1 | 1 | FIRST SERIAL BIT STREAM TO BE SHIFTED |
| 1 | 1 | 1 | 1 | SECOND SERIAL BIT STREAM TO BE SHIFTED |
| 1 | 1 | 1 | 1 | THIRD SERIAL BIT STREAM TO BE SHIFTED |
| 1 | 0 | 1 | 1 | FOURTH SERIAL BIT STREAM TO BE SHIFTED |
| 1 | 0 | 0 | 1 | FIFTH SERIAL BIT STREAM TO BE SHIFTED |
| 1 | 0 | 0 | 1 | SIXTH SERIAL BIT STREAM TO BE SHIFTED |
| 1 | 0 | 0 | 0 | SEVENTH SERIAL BIT STREAM TO BE SHIFTED |

FIG. 5C

| FIRST LINE IMAGE DATA (DEFLECTION CORRECTING PULSES) | | | | |
|---|---|---|---|---|
| IMAGE DATA =2 (1ST NOZZLE) | IMAGE DATA =5 (2ND NOZZLE) | IMAGE DATA =0 (3RD NOZZLE) | IMAGE DATA =1 (4TH NOZZLE) | |
| 0 | 0 | 0 | 1 | FIRST SERIAL BIT STREAM TO BE SHIFTED |
| 1 | 0 | 0 | 0 | SECOND SERIAL BIT STREAM TO BE SHIFTED |
| 0 | 0 | 0 | 0 | THIRD SERIAL BIT STREAM TO BE SHIFTED |
| 0 | 0 | 0 | 0 | FOURTH SERIAL BIT STREAM TO BE SHIFTED |
| 0 | 1 | 0 | 0 | FIFTH SERIAL BIT STREAM TO BE SHIFTED |
| 0 | 0 | 0 | 0 | SIXTH SERIAL BIT STREAM TO BE SHIFTED |
| 0 | 0 | 0 | 0 | SEVENTH SERIAL BIT STREAM TO BE SHIFTED |

A

FIG. 6A

| FIRST LINE IMAGE DATA (OPERATIONAL PULSES) | | | | |
|---|---|---|---|---|
| IMAGE DATA =2 (1ST NOZZLE) | IMAGE DATA =5 (2ND NOZZLE) | IMAGE DATA =0 (3RD NOZZLE) | IMAGE DATA =1 (4TH NOZZLE) | |
| 1 | 1 | 0 | 1 | FIRST SERIAL BIT STREAM TO BE SHIFTED |
| 1 | 1 | 0 | 0 | SECOND SERIAL BIT STREAM TO BE SHIFTED |
| 0 | 1 | 0 | 0 | THIRD SERIAL BIT STREAM TO BE SHIFTED |
| 0 | 1 | 0 | 0 | FOURTH SERIAL BIT STREAM TO BE SHIFTED |
| 0 | 1 | 0 | 0 | FIFTH SERIAL BIT STREAM TO BE SHIFTED |
| 0 | 0 | 0 | 0 | SIXTH SERIAL BIT STREAM TO BE SHIFTED |
| 0 | 0 | 0 | 0 | SEVENTH SERIAL BIT STREAM TO BE SHIFTED |

B

FIG. 6C

METHOD OF CONTROLLING HEATERS IN A CONTINUOUS INK JET PRINT HEAD HAVING SEGMENTED HEATERS TO PREVENT TERMINAL INK DROP MISDIRECTION

FIELD OF THE INVENTION

The present invention relates to a method of controlling power to a continuous ink jet print head to maintain proper directionality of a stream of droplets at the end of a printing operation. In particular, the present invention relates to a method of timing a deflection correcting electrical pulse relative to operational pulses of an asymmetric thermal droplet deflector of a continuous ink jet printer.

BACKGROUND OF THE INVENTION

Ink jet printing has become recognized as a prominent contender in the digitally controlled, electronic printing arena because of various advantages such as its non-impact, low noise characteristics and system simplicity. For these reasons, ink jet printers have achieved commercial success for home and office use and other areas.

Traditionally, color ink jet printing is accomplished by one of two technologies, referred to as drop-on-demand and continuous stream printing. Both technologies require independent ink supplies for each of the colors of ink provided. Ink is fed through channels formed in the print head. Each channel includes a nozzle from which droplets of ink are selectively extruded and deposited upon a medium. Each technology requires separate ink delivery systems for each ink color used in printing. Ordinarily, the three primary subtractive colors, i.e. cyan, yellow and magenta, are used because these colors can produce up to several million perceived color combinations.

In drop-on-demand ink jet printing, ink droplets are generated for impact upon a print medium using a pressurization actuator (thermal, piezoelectric, etc.). Selective activation of the actuator causes the formation and ejection of an ink droplet that crosses the space between the print head and the print medium and strikes the print medium. The formation of printed images is achieved by controlling the individual formation of ink droplets as the medium is moved relative to the print head.

In continuous stream or continuous ink jet printing, a pressurized ink source is used for producing a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism. While such continuous ink jet printing devices are faster than drop on demand devices and produce higher quality printed images and graphics, the electrostatic deflection mechanism they employ is expensive to manufacture and relatively fragile during operation.

Recently, a novel continuous ink jet printer system has been developed which renders the above-described electrostatic charging devices unnecessary and provides improved control of droplet formation. The system is disclosed in the commonly assigned U.S. Pat. No. 6,079,821 in which periodic application of weak heat pulses to the ink stream by a heater causes the ink stream to break up into a plurality of droplets synchronous with the applied heat pulses and at a position spaced from the nozzle. The droplets are deflected by heat pulses from a heater in a nozzle bore. This is referred to as asymmetrical application of heat pulses. The heat pulses deflect ink drops between a "print" direction (onto a recording medium), and a "non-print" direction (back into a "catcher").

While such continuous ink jet printers utilizing asymmetrical application of heat have demonstrated many proven advantages over conventional ink jet printers utilizing electrostatic charging tunnels, it has been noted that at the end of a printing operation, the next droplet or droplets directed toward the gutter may be directed toward the printing medium instead. U.S. Pat. No. 6,254,225 assigned to the assignees of the present application and which is incorporated herein by reference, discloses a method for controlling a terminal flow of ink droplets from the nozzle of an ink jet printer at the end of a printing operation to correct this deficiency. It is noted that because the '225 patent was not issued until Jul. 3, 2001, it is not prior art with respect to the inventions claimed in the present application.

The cause of such droplet misdirection is not entirely understood but it is believed that this deficiency is caused by the non-instantaneous thermal response time of the heated portion of the nozzle to cool back to ambient temperature. Since the amount of the drop deflection is directly related to the temperature of the ink, and since the heated half of the ink jet nozzle does not cool instantaneously, it is believed that, after the end of a printing operation, the first ink droplet formed is misdirected away from the ink gutter and toward the printing medium due to the residual heat of the ink jet nozzle. Whether or not the second or third subsequent droplets are similarly misdirected is dependent upon the residual heat of the print head in the vicinity of the nozzles, the viscosity and thermal properties of the ink, and other thermal and fluid dynamic factors. Any such misdirected droplets can interfere with the objective of obtaining high image quality printing from such devices.

To correct the above described deficiency, the '225 discloses a printer having a first heater element disposed on one side of the nozzle that is selectively actuated to direct ink droplets away from a recording medium and into an ink gutter during a printing operation. The printer also has a second heater element disposed on the side of the nozzle opposite from the first heater element. After the first heater element applies its last operational heat pulse to the printing nozzle at the end of a printing operation, the second heater element applies at least one deflection correcting heat pulse of the same duration, magnitude and period as the last operational heat pulse. The method as described in the '225 reference prevents ink droplets generated after the end of a printing operation from erroneously striking the printing medium.

Whereas a method for preventing ink droplets generated after the end of a printing operation from erroneously striking the printing medium is provided in the '225 reference, an accurate and efficient method for controlling the deflection correcting electrical pulse provided to the second heater element disposed on the side of the nozzle opposite from the first heater element is not disclosed.

SUMMARY OF THE INVENTION

In the above regard, the present inventors recognized that efficient and accurate timing of the electrical pulse that operates the second heater element is not known. Moreover, it has also been recognized that in certain applications, it may be desirable to adjust the timing of the electrical pulse that operates the second heater element.

In view of the above, one advantage of the present invention is in providing an accurate and efficient method for preventing misdirection of ink droplets at the end of a printing operation.

In this regard, another advantage of the present invention is in providing a method for controlling the timing of the deflection correcting electrical pulse for the second heater element disposed on the side of the nozzle opposite from the first heater element.

In accordance with the preferred embodiment of the present invention, these advantages are obtained by a method for timing a deflection correcting electrical pulse relative to operational pulses of an asymmetric thermal droplet deflector of a continuous ink jet printer having plurality of nozzles, comprising the steps of generating at least one line image data with a plurality of image data values corresponding to the plurality of nozzles, the plurality of image data values being indicative of desired pixel graytone levels for the plurality of nozzles, comparing the plurality of image data values to a reference value, generating at least one serial bit stream in the form of serially arranged bits based on the comparison of the image data values to the reference value, and producing an actuation value that times the deflection correcting electrical pulse in the serial bit stream when the image data value is equal to the reference value.

In accordance with one embodiment, the method also includes the step of generating the deflection correcting electrical pulse timed to the actuation value in the serial bit stream. In still another embodiment, the method also includes the step of iteratively comparing the plurality of image data values of the line image data with the reference value.

The actuation value produced to time the deflection correcting electrical pulse is a digital 1. In one embodiment, the reference value increases in uniform increments. In this regard, the method may further include the step of generating the deflection correcting electrical pulse timed to the actuation value in the serial bit stream. The method may also include the step of iteratively comparing the plurality of image data values of the line image data with the reference value as the reference value is increased in uniform increments. The reference value may be started at 1 so that the deflection correcting electrical pulse is generated concurrently timed with last operational pulses for each of the plurality of nozzles. Alternatively, the reference value may be started less than 1 so that the deflection correcting electrical pulse is generated subsequent to last operational pulses for each of the plurality of nozzles. For instance, the reference value may be started at 0, −1, or −2 so that the deflection correcting electrical pulse is generated one, two, or three predetermined time periods respectively, subsequent to last operational pulses for each of the plurality of nozzles.

In accordance with one embodiment, the total number of iterations of comparing the plurality of image data values of the line image data with the reference value is less than or equal to the total number of pixel graytone levels. In another embodiment, the total number of iterations exceeds the total number of pixel graytone levels.

In accordance with yet another embodiment of the present invention, the reference value is a plurality of reference values stored in a look up table. In this regard, at least first of the plurality of reference values is 0 so that the deflection correcting electrical pulse is generated subsequent to last operational pulses for each of the plurality of nozzles. In addition, the method may further include the step of iteratively comparing the plurality of image data values of the line image data with the plurality of reference values stored in the look up table.

In accordance with still another aspect of the present invention, a method for timing a deflection correcting electrical pulse relative to an operational pulse of an asymmetric thermal droplet deflector of a continuous ink jet printer is provided, the method comprising the steps of generating line image data with plurality of image data values indicative of desired pixel graytone levels, iteratively comparing the plurality of image data values to a reference value at predetermined time periods, generating a serial bit stream with an actuation value based on the comparison of the plurality of image data values to the reference value, and generating the deflection correcting electrical pulse based on the actuation value, the deflection correcting electrical pulse being timed within a predetermined number of time periods of the operational pulse.

In accordance with one embodiment, the deflection correcting electrical pulse is generated in the same time period of the operational pulse. Alternatively, the deflection correcting electrical pulse is generated in a time period subsequent to the operational pulse. In this regard, the deflection correcting electrical pulse is generated in one or two time periods subsequent to the operational pulse. In one embodiment, the reference value increases in uniform increments, while alternatively, in another embodiment, the reference value is a plurality of reference values stored in a look up table.

These and other advantages and features of the present invention will become more apparent from the following detailed description of the invention when viewed in conjunctions with the accompanying drawings.

DETAILED DESCRIPTION OF THE INVENTION

Figure 1:
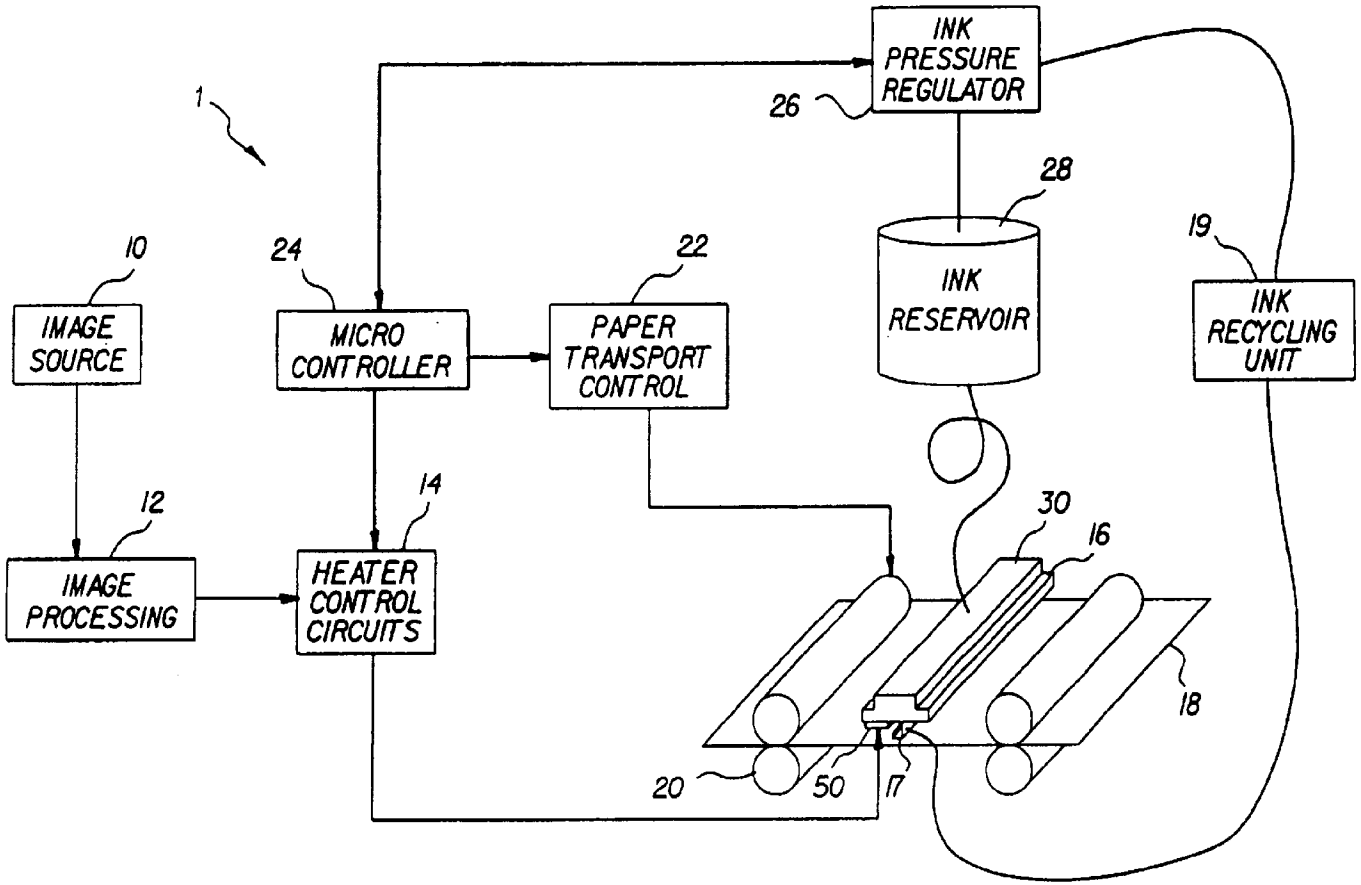
FIG. 1 is a schematic block diagram of an asymmetric heat-type continuous ink jet printing apparatus capable of implementing the method of the present invention.

FIG. 1 is a schematic block diagram of an asymmetric heat-type continuous ink jet printer system 1 capable of implementing the method of the present invention. The printer system 1 includes an image source 10 such as a scanner or computer which provides raster image data, outline image data in the form of a page description language, or other forms of digital image data. This image data is processed by an image processing unit 12 which also stores the image data in a memory (not shown). In this regard, the image processing unit 12 may perform various image enhancing algorithms, color correction to match the output devices, etc. A heater control circuit 14 which is controlled in the present embodiment by the micro-controller 24 reads data from the image memory and applies electrical pulses to a heater 50 that applies heat to a nozzle that is part of a print head 16. These pulses are applied at an appropriate time, and to the appropriate nozzle as described in further detail below, so that drops formed from a continuous inkjet stream will print spots on a recording medium 18 in the appropriate position designated by the data in the image memory and in the appropriate darkness or pixel graytone level.

Recording medium 18 is moved relative to print head 16 by a recording medium transport system 20 which is electronically controlled by a recording medium transport control system 22 which in turn, is controlled by a micro-controller 24. The recording medium transport system is shown in FIG. 1 as a schematic only, and many different mechanical configurations are possible in various embodiments. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is preferably contained in an ink reservoir 28 under pressure. In the nonprinting state, continuous ink jet drop streams are unable to reach recording medium 18 due to an ink gutter 17 that blocks the ink jet drop stream and which may be operated to allow a portion of the ink to be recycled by an ink recycling unit 19. The ink recycling unit 19 reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface where a plurality of nozzles and heaters are situated. Of course, with print head 16 fabricated from silicon, it is possible to integrate heater control circuits 14 with the print head. The mechanics of the generation and deflection of ink droplets of the ink stream is presented in U.S. Pat. No. 6,079,821 described previously and thus, further detail is omitted here.

As will be appreciated from the discussion herein below, the present invention provides an accurate and efficient method which may be implemented by the printer system 1 for controlling the timing and adjustment of the timing of the deflection correcting electrical pulse for the second heater element disposed on the side of the nozzle opposite from the first heater element as described in U.S. Pat. No. 6,254,255 described previously. In this regard, the print head 16 may be controlled by the heater control circuits 14 which are operated by the micro-controller 24 in accordance with the present invention discussed below to provide such timing control and adjustment of the deflection correcting electrical pulse.

Figure 2:
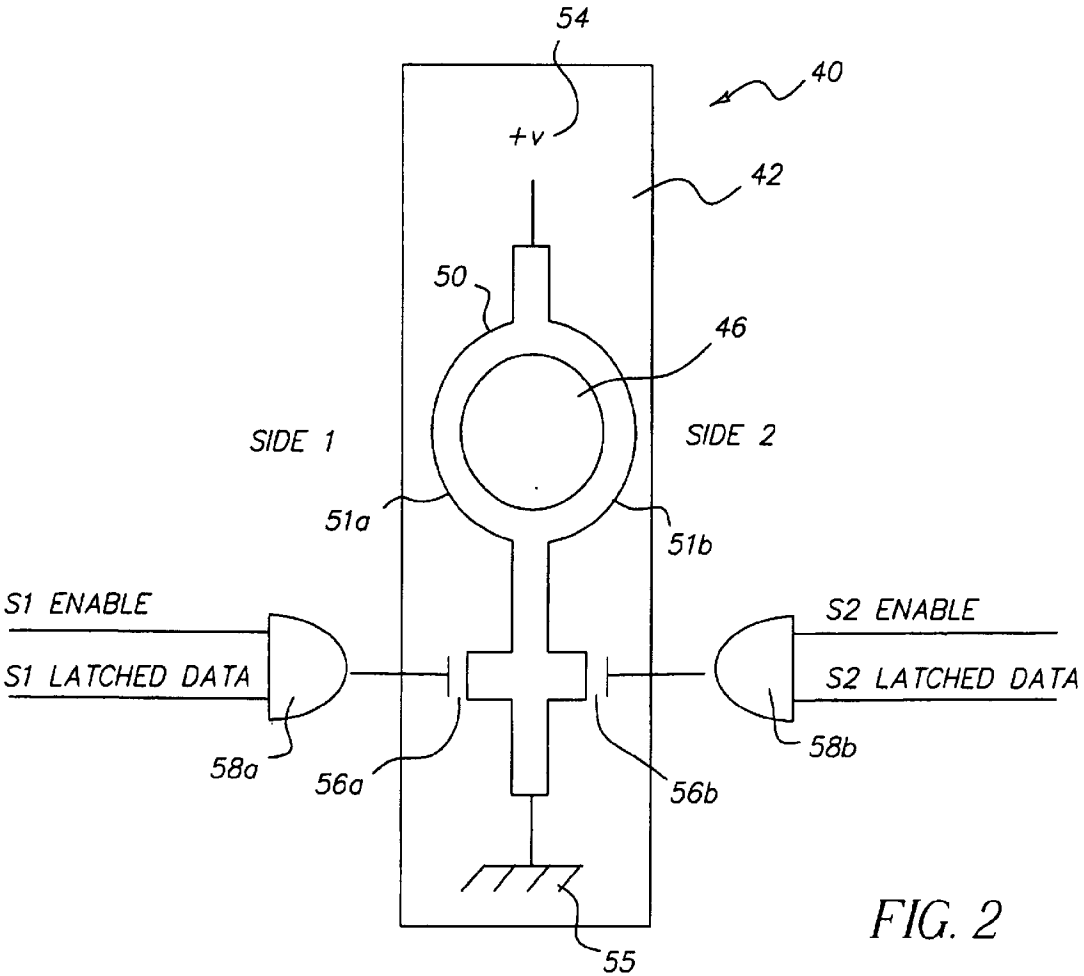
FIG. 2 is a schematic diagram of an exemplary embodiment of a nozzle provided on the print head, the nozzle having a first heater element for deflecting the ink droplets and a second heater element actuated by a deflection correcting electric pulse.

FIG. 2 is a schematic diagram of an exemplary embodiment of one nozzle 40 with a nozzle bore 46 provided on the print head 16 with a heater 50 substantially encircling the nozzle bore 46. Of course, the print head 16 may be provided with a plurality of such nozzles and corresponding heaters as well. The heater 50 in the illustrated example has a pair of opposing semicircular elements covering almost all of the nozzle perimeter. In particular, the heater 50 has a first heater element 51*a* positioned on SIDE 1 in the present figure which is operable to deflect the ink droplets so that they impinge on the recording medium 18 or are captured by the gutter 17 shown in FIG. 1. The heater 50 further includes a second heater element 51*b* positioned on SIDE 2 which is operable by a deflection correcting electric pulse which may be used to prevent ink droplets generated after the end of a printing operation from erroneously striking the recording medium 18. Of course, in other embodiments, the heater elements may be of any appropriate shape.

As can be seen, the first and second heater elements 51*a* and 51*b* respectively are connected to a power source 54 and ground 55, the power for the first heater element 51*a* and the second heater element being turned on and off by driver transistors 56*a* and 56*b* respectively. The driver transistors 56*a* and 56*b* are engaged by a signal from AND gates 58*a* and 58*b* respectively, such signal being provided by each of the AND gates when the "ENABLE" and "LATCHED DATA" signals for the corresponding AND gate is received. When the driver transistors 56*a* or 56*b* are engaged, the respective heater element is activated to cause deflection of the ink droplets, again, the heater element 51*b* being timed by a deflection correcting electrical pulse.

Electrical pulses or pulse trains from the heater control circuit 14 is provided to the first heater element 51*a* so that the asymmetric application of heat generated on SIDE 1 of the nozzle bore 46 to periodically deflect the ink droplets stream during a printing operation by the heater section 51*a*. Control circuit 14 may be programmed to control power to the first heater element 51*a* of the heater 50 in the form of pulses described in further detail below, deflection of an ink droplet occurring whenever an electrical power pulse by the AND gate 58*a* is provided. In one embodiment, the deflected ink droplets reach the recording medium 18 while the undeflected drops may be blocked from reaching recording medium 18 by a cut-off device such as the ink gutter 17 noted above. In an alternate printing scheme, ink gutter 17 may be placed to block deflected drops so that undeflected drops will be allowed to reach recording medium 18.

The heater elements 51*a* and 51*b* of heater 50 may be made of doped polysilicon, although other resistive heater materials could be used. Heater 50 is separated from substrate 42 by thermal and electrical insulating layer (not shown) and the nozzle bore 46 may be etched. The surface of the print head 16 can be coated with a hydro-phobizing layer (not shown) to prevent accidental spread of the ink across the front of the print head 16.

Figure 3:
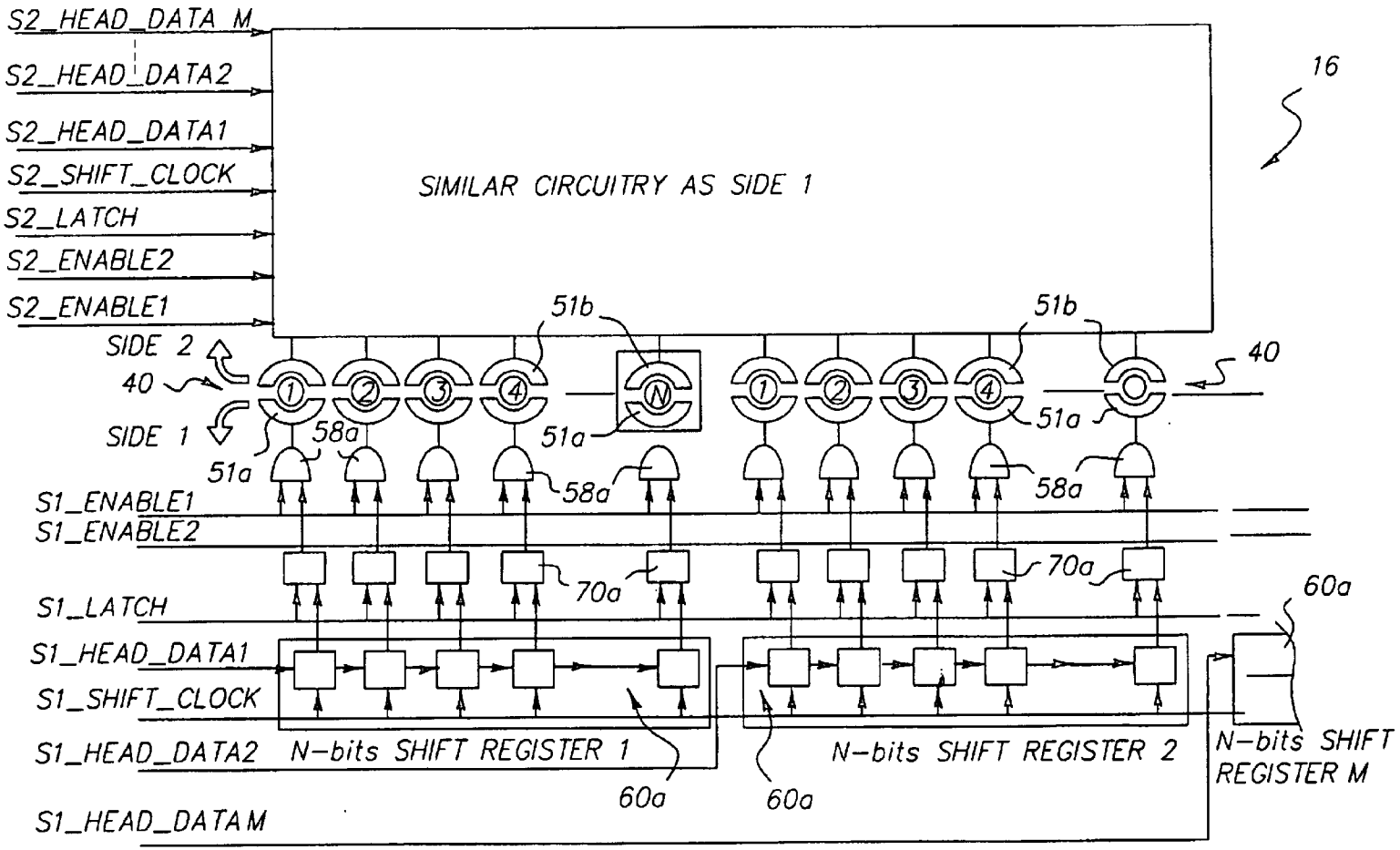
FIG. 3 is a schematic diagram of one configuration of a print head in accordance with one embodiment having a plurality of nozzles showing the circuitry of SIDE 1.

The operation of the first heater elements 51*a* of the heater 50 on the print head 16 which are actuated to deflect the ink droplets is described herein below so that fuller appreciation of the operation of the second heater elements 51*b* in accordance with the present invention as discussed later may be attained. In this regard, FIG. 3 shows one example configuration of a print head 16 with plurality of nozzles 40 having the first heater elements 51*a* and second heater elements 51*b*. As can be appreciated, only representative elements have been enumerated to simplify the figure and the specific components and the signals received are referred to directly. In this regard, FIG. 3 shows the details of SIDE 1 which is operable to control the first heater elements 51*a* of the nozzles 40 to deflect the ink droplets so that they impinge on the recording medium 18 or are captured by the gutter 17 shown in FIG. 1. Moreover, as indicated in FIG. 3, the details of SIDE 2 is substantially similar to the details of SIDE 1 and thus, have been omitted to minimize confusion and to enhance understanding of FIG. 3. However, it should be appreciated that SIDE 2 is operable in a manner similar to SIDE 1 to control the second heater elements 51*b* to prevent ink droplets generated after the end of a printing operation from erroneously striking the recording medium 18.

To control the large number of heaters, the ink jet print head 16 further includes plurality of electronic serial shift registers 60*a* on SIDE 1 and serial shift registers on SIDE 2 (not shown), in this case, M serial shift registers per side, to minimize the number of electrical connections between the heater control circuit 14 and the print head 16. Each serial shift register may be 1-bit wide by N-bits long as shown in FIG. 3. Thus, N×M is the total number of heaters per side (SIDE 1 and SIDE 2) in the print head 16. In this regard, in FIG. 3, S1 and S2 prefixes are used for the various signals to indicate SIDE 1 or SIDE 2 respectively but is generally omitted since both of these sides are provided with similar signals and only SIDE 1 is discussed in detail relative to FIG. 3. In addition, the signals are also designated with suffixes 1 or 2 if it aids in clarifying the particular signal in FIG. 3. However, these signals are also designated with "x" below to indicate the signal generally.

The SHIFT_CLOCK signal is used to move the digital data value of 1 or 0 present at the HEAD_DATA1 and HEAD_DATA2 signals through the SHIFT REGISTER 1 and SHIFT REGISTER 2 respectively. One bit of data is shifted for each clock pulse per shift register. The serial shift registers are analogous to a bucket brigade, where the contents of a register location (for instance at P) is moved into a subsequent register location (P+1) on the rising edge or other portion of the clock signal. The contents of register location (P−1) is moved into location (P) on this same clock signal. Thus, to fill all N locations of SHIFT REGISTER 1 and SHIFT REGISTER 2 with new data from the HEAD_DATA1 and HEAD_DATA2 signal requires N clock periods in the illustrated embodiment.

In addition to the serial shift registers shown in FIG. 3, the print head 16 contains a separate set of latch registers 70*a*, and as shown, each of the bits in the serial shift registers having an associated latch register 70*a*. Therefore, in the illustrated embodiment, there are N×M latch registers 70*a*. The operation of the latch registers 70*a* is controlled by the LATCH signal. During normal operation of the print head 16, the latch registers 70*a* hold a set of constant data values for the first heater elements 51*a* while a new set of data is being clocked into the serial shift registers 60*a*. When the serial shift registers 60*a* have been filled with N new data values, the LATCH signal pulses high. The high pulse on the LATCH signal transfers the contents of all M serial shift registers 60*a* into their associated latch registers 70*a*. The contents of the latch registers 70*a* and their associated outputs remain constant until the next LATCH pulse occurs.

As shown in FIGS. 2 and 3, the output of each latch register 70*a* is connected to an associated digital AND gate 58*a* which was described above relative to FIG. 2. The output of each AND gate 58*a* is connected to an associated driver transistor 56*a* also described above which is used to apply power to the first heater element 51*a* associated with each nozzle 40. The driver transistor 56*a*, for example, could be an open collector NPN transistor or an open drain N-channel power MOSFET device as shown in FIG. 2, which acts as a simple electrically controlled ON/OFF switch for the first heater element 51*a*.

A second signal, generically referred to as ENABLEx, and in the present example, the ENABLE1 and ENABLE2 signal, is connected in common to the AND gates 58*a* within each heater group. In this regard, in simple print head configurations, there may be just one heater group where all heaters are connected to one ENABLE signal for the whole print head. In other configurations, especially for larger nozzle count such as the embodiment shown in FIG. 3, the print head 16 may be divided into several heater groups, each group having its own ENABLEx signal such as the ENABLE1 and ENABLE2 signals shown for the present illustrated example. One reason why the heaters are divided into heater groups is to minimize power supply requirements since each heater group can be selectively energized in succession. This would avoid the need to energize all the heaters on the print head at the same time which would increase power supply requirements.

Thus, as previously described, for an individual first heater element 51*a* to be energized to heat one side of the nozzle 40, two conditions must be true in the present embodiment:

(1) The contents of the associated latch register must be a digital 1; and (2) The ENABLEx signal for the heater group that the first heater element is part of must be a digital 1.

When both signals to the AND gate 58*a* are digital 1, the output of the AND gate 58*a* is a digital 1 so that the associated driver transistor 56*a* is turned ON and power is applied to the first heater element 51*a*. In accordance with the illustrated embodiment, the ENABLEx signal defines the ON time for any first heater element 51*a*, and the output of the associated latch register 70*a* controls whether a heater is ON or OFF during a particular printing operation so that the appropriate graytone level L of the continuous G graytones can be attained. In this regard, it should be noted that the maximum number of graytones is referred to herein as G graytones whereas the actual graytone level of a given particular pixel is referred to herein as graytone level L. Thus, in the examples discussed herein below, maximum of 8 graytones are possible (G=8), the graytone levels L being 0, 1, 2 . . . 6, 7. It should be noted that 0 is considered as one of the graytone levels since it represents minimum print density (i.e. no ink) and graytone level 7 is the darkest graytone level. Of course, in other examples, different number of graytone levels are possible as well.

Figure 4:
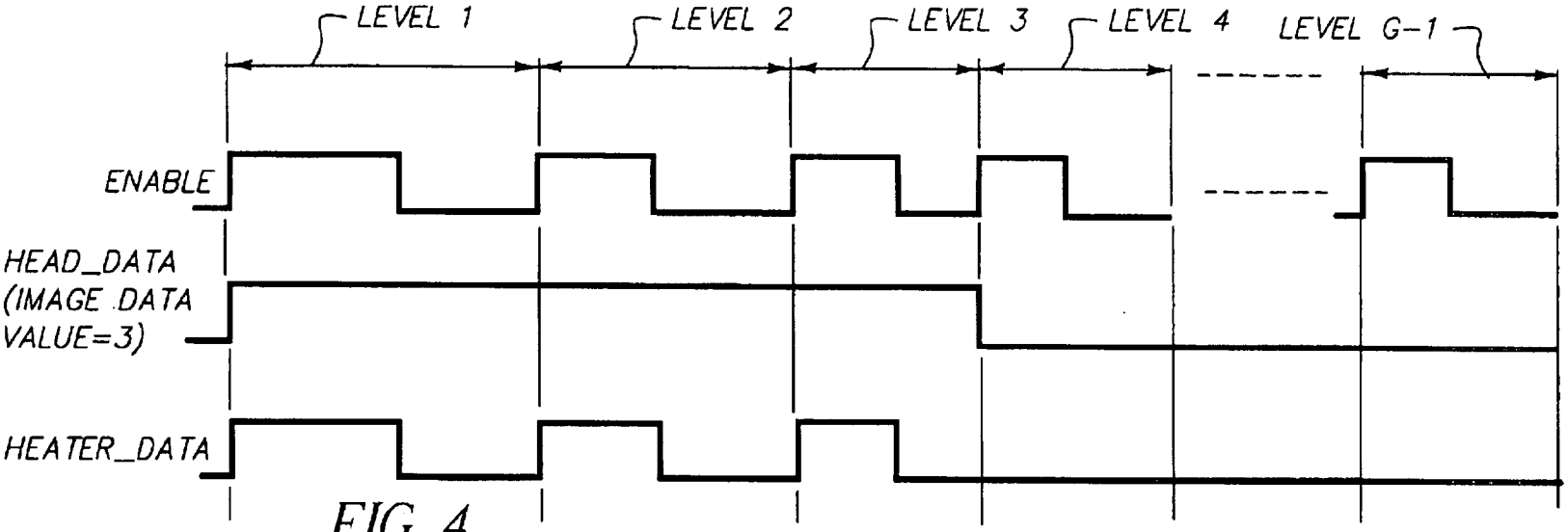
FIG. 4 is a schematic illustration of the ENABLE and HEAD_DATA signals which are combined to provided the HEATER_DATA in accordance with one embodiment of the present invention.

FIG. 4 shows an example of an electrical pulse train provided to the first heater elements 51*a* on SIDE 1 of one of the nozzles 40 of the continuous tone ink jet printer system 1 capable of printing pixels having up to the maximum G graytones, present embodiment showing a pulse train which will print a pixel with a graytone level of 3. As can be seen by viewing FIGS. 3 and 4 together, FIG. 4 illustrates the ENABLEx signals provided to the AND gates 58*a*, and HEAD_DATAx signals which are provide to the shift registers 60*a*, the HEAD_DATAx being correlated to the image data value which is indicative of the graytone level L of the image to be printed.

With respect to the operation of the first heater elements 51*a* on SIDE 1, the ENABLEx signal is pulsed G−1 times, the ENABLEx signal not being pulsed when graytone level is 0 which signifies the minimum density when no printing occurs. In the illustrated example of FIG. 4, the HEAD_DATAx that is to be shifted in to the shift register 60*a* for a particular first heater element 51*a* consists of three digital values of 1 and the remainder being 0. When the shifted HEAD_DATAx is a digital 1, the first heater element 51*a* is pulsed ON for the time duration which is controlled by the ENABLEx signal for that particular graytone level. When the shifted HEAD_DATAx is a digital 0, the heater is OFF regardless the state of the ENABLEx signal. Therefore, the ENABLEx signal establishes the maximum number of times any first heater element 51*a* can be pulsed ON, which in the present embodiment, is the maximum graytone level L that can be printed. The HEAD_DATAx shifted into the serial shift register 60*a* controls the number of times a particular heater will be pulsed ON to produce the desired graytone level in the printed image. Thus, in this example, since the HEAD_DATAx signal is provided for graytone levels 1, 2, and 3, the corresponding first heater element 51*a* is actuated by the HEATER_DATA pulse train as shown which is provided by the corresponding AND gate 58*a* and is derived from the ENABLEx signal and the HEAD_DATAx signal.

Stated in another manner, whereas the ENABLEx signal establishes the timing of the operation of the first heater element 51*a* up to the maximum G graytones, the HEAD_DATAx signal determines the actual number of the operation of the first heater element 51*a* since it is correlated to the image data value. Correspondingly, both of these signals are used to generate the HEATER_DATA pulse train as shown which is used to actuate the first heater element 51*a* to deflect the continuous ink jet droplets.

The ENABLE signal may be generated in any appropriate manner to practice the present invention as further described below. Thus, the details of generating the ENABLE signal are omitted herein. However, one method of generating the ENABLE signal is discussed in detail in application entitled METHOD AND APPARATUS FOR CONTROLLING HEATERS IN A CONTINUOUS INK JET PRINT HEAD (Docket 81912) commonly assigned to the assignees of the present application, which is incorporated herein by reference.

Figure 5:
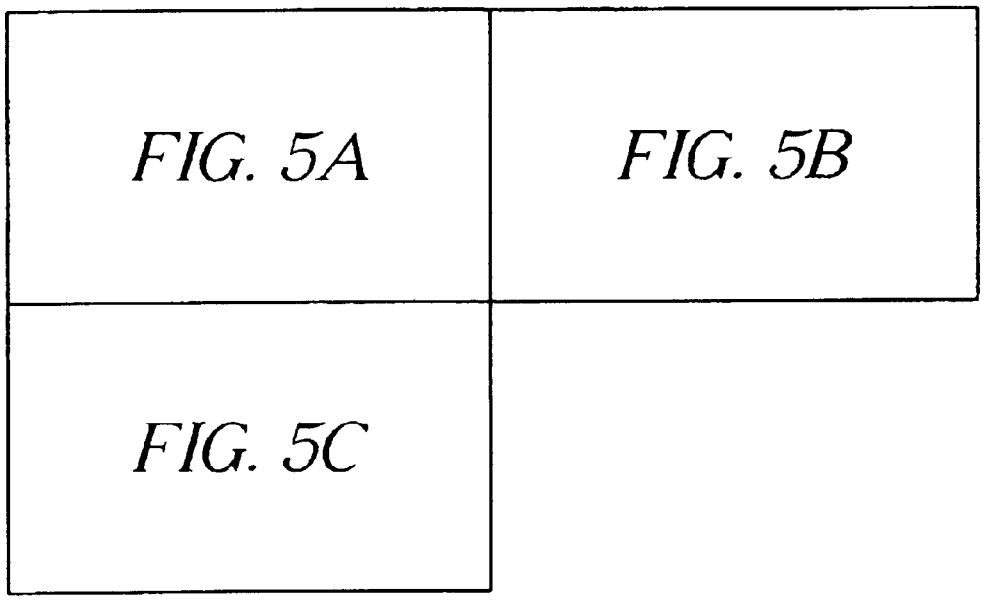
FIG. 5 is a schematic diagram of another example configuration of a print head having a plurality of nozzles showing the circuitry of SIDE 1 with the first heater elements and the first and second line image data provided to the shift register of SIDE 1.
Figure 5B:
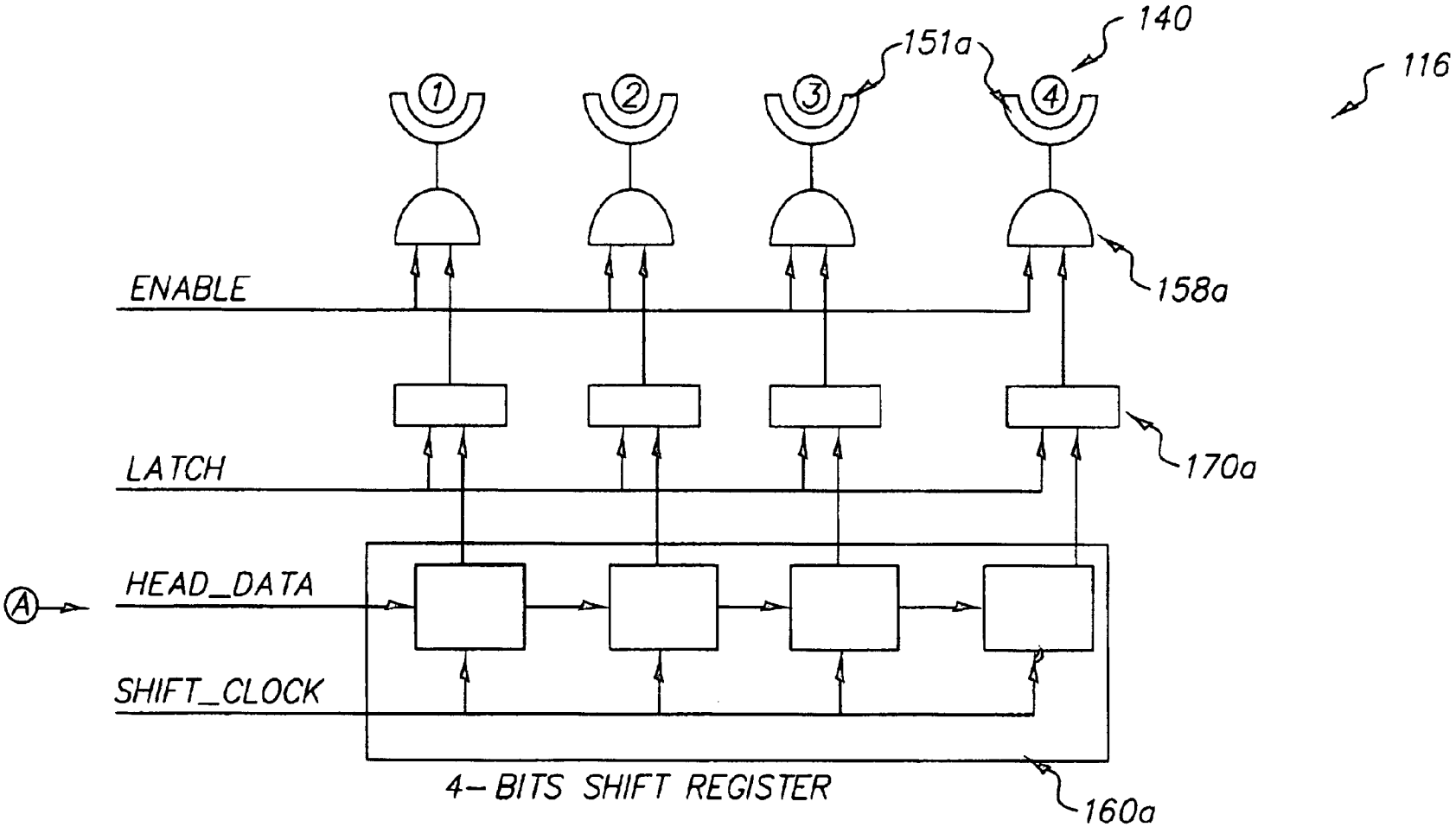

The generation of the HEAD_DATA signal is discussed below. Most electronic devices such as computers store pictorial image data in a parallel form where 1 byte is 8 bits of digital binary data. The print head in accordance with the present invention as described above which utilizes a serial shift register requires the data to be in the serial form. Thus, the parallel image data must be converted to a serial bit stream. FIG. 5 shows an example of SIDE 1 of print head 116 similar to that already discussed which illustrates how the parallel image data is converted to a serial bit stream. SIDE 2 of print head 116 has been omitted here to more clearly illustrate the operation of SIDE 1. As can be seen, in this illustrated example, the print head 116 is very short and contains only four nozzles 140, each nozzle 140 having individual first heater elements 151*a* in the manner discussed above. In addition, a single serial shift register 160*a* is provided for the print head 116 which is a printing system with 8 graytones so that the maximum graytones G is equal to 8. This means that image data for each pixel can take any value between 0 and 7, where graytone level 0 represents the lowest density level in which no ink is provided, and where graytone level 7 represents the highest density level that can be printed.

The discussion below presents example image data to be printed by the print head 116 of FIG. 5, the line image data for each nozzle 140 being the following:

TABLE 1

| Nozzle: | 1st | 2nd | 3rd | 4th |
|---|---|---|---|---|
| First line image data: | 2 | 5 | 0 | 1 |
| Second line image data: | 7 | 3 | 4 | 6 |

As can be seen from TABLE 1 above, for the first line image data of the present example, the $1^{st}$ nozzle is to print a pixel at graytone level 2 while the $2^{nd}$ nozzle is to print a pixel at graytone level 5, and so forth for the $3^{rd}$ and $4^{th}$ nozzles. In a like manner, for the second line image, the $1^{st}$ nozzle is to print a pixel at graytone level 7, the $2^{nd}$ nozzle is to print a pixel at graytone level 3, etc. Correspondingly, the first line image data includes image data values 2, 5, 0, and 1 while the second line image data includes image data values 7, 3, 4, and 6.

The above line image data values are converted into a serial bit stream corresponding to the number of ink droplets that will be printed to get the desired density, i.e. the graytone level L, for each pixel printed by the corresponding nozzle. The process of converting the parallel data into a serial bit stream is attained via modulation. In accordance with the illustrated embodiment, the parallel data is converted to a serial bit stream using repeated comparisons to a reference value which is incremented each time the serial shift register 160*a* has been completely filled with new data, i.e. HEAD_DATA.

In particular, upon comparing the image data values with a reference value, if the image data value is greater than the reference value, a digital 1 is produced and shifted into the print head serial shift register 160*a*. If the image data value is not greater than the reference value, a digital 0 is produced and shifted into the print head serial shift register 160*a*. The reference value is incremented in a sequential manner and the comparison process is repeated for each of the line image data. TABLE 2 below shows the results of this comparison for the first line of image data of TABLE 1.

TABLE 2

| First Line Image Data | Reference Values 0 | 1 | 2 | 3 | 4 | 5 | 6 |
|---|---|---|---|---|---|---|---|
| | Comparison Results {= 1 if (Image Data > Reference Value) otherwise = 0} | | | | | | |
| 2 | 1 | 1 | 0 | 0 | 0 | 0 | 0 |
| 5 | 1 | 1 | 1 | 1 | 1 | 0 | 0 |
| 0 | 0 | 0 | 0 | 0 | 0 | 0 | 0 |
| 1 | 1 | 0 | 0 | 0 | 0 | 0 | 0 |
| | First serial bit stream to be shifted | Second serial bit stream to be shifted | Third serial bit stream to be shifted | Fourth serial bit stream to be shifted | Fifth serial bit stream to be shifted | Sixth serial bit stream to be shifted | Seventh serial bit stream to be shifted |

As can be seen from examination of TABLE 2, in the present example, the first line image data for the $1^{st}$ nozzle is 2 which means that for the first line, the $1^{st}$ nozzle is to generate a pixel having graytone level of 2 which means that 2 ink droplets must be provided for the particular pixel.

Correspondingly, this means that the first heater element 51*a* must be actuated twice out of the total of seven actuations possible. This image data of 2 is compared to the reference value of 0. Since the image data of 2 is greater than 0, a digital 1 is produced for the first serial bit stream. The same process is applied to the first line image data for the $2^{nd}$ nozzle which is 5, 5 being greater than the reference value 0 so a digital 1 is produced for the first serial bit stream. For the $3^{rd}$ nozzle, the first line image data is 0 so it is not greater than the reference value 0 so that a digital 0 is produced for the first serial bit stream. Finally, the first line image data for the $4^{th}$ nozzle which is 1 is greater than the reference value 0 so a digital 1 is produced for the first serial bit stream. With the first serial bit stream now completed, it is sent to the shift register 160*a* as HEAD_DATA and is correspondingly provided to the latch registers 170*a* in the manner described above upon the providing of the latch signal as also described in farther detail below.

For the operation of the first heater elements 51*a* on SIDE 1, this process is repeated for each of the reference values which are incremented. In general, the comparison must be done G−1 times, again, G being the total number of graytone levels as described above. Thus, to print one line of image data in the above example (e.g. the first line image data), seven (7) serial bit streams must be sent to the print head 116 in the present example, and in particular, be sent as HEAD_DATA to the shift register 160*a* of the print head 116 in the manner shown in FIG. 5. In this regard, it should be readily apparent that the FIRST LINE IMAGE DATA table shown in FIG. 5 correlates to TABLE 2 discussed above but the line image data is shown in individual columns and each serial bit stream is shown as a row in FIG. 5 so that the rows and columns of TABLE 2 are presented as columns and rows respectively in the table of FIG. 5. This presentation of the corresponding HEAD_DATA is provided merely to clearly illustrate that each serial bit stream is provided to the shift register 160*a*, each serial bit stream having the first line image data for each of the nozzles 140, in this case, four nozzles.

After each serial bit stream is completed, it is shifted into the serial shift register 160*a*. A LATCH signal is provided to latch the bit value (0 or 1) into the corresponding latch register 170*a*. Then, the ENABLEx signal is activated. The reference value is then reset to zero and the whole process is repeated again for the next line of image data. TABLE 3 below shows the comparison results for the second line of image data.

TABLE 3

| Second Line Image Data | Reference Values 0 | 1 | 2 | 3 | 4 | 5 | 6 |
|---|---|---|---|---|---|---|---|
| | Comparison Results {= 1 if (Image Data > Reference Value) otherwise = 0} | | | | | | |
| 7 | 1 | 1 | 1 | 1 | 1 | 1 | 1 |
| 3 | 1 | 1 | 1 | 0 | 0 | 0 | 0 |
| 4 | 1 | 1 | 1 | 1 | 0 | 0 | 0 |
| 6 | 1 | 1 | 1 | 1 | 1 | 1 | 0 |
| | First serial bit stream to be shifted | Second serial bit stream to be shifted | Third serial bit stream to be shifted | Fourth serial bit stream to be shifted | Fifth serial bit stream to be shifted | Sixth serial bit stream to be shifted | Seventh serial bit stream to be shifted |

Of course, the above describes only two lines of exemplary image data and in this example, the maximum graytones G is 8 as previously described with graytone level 0 being the minimum print density, i.e. white space. However, in other embodiments, additional and different lines of image data may be processed in the manner described above having different maximum graytones as well. In the above described manner, the first heater elements 51*a* as shown in FIG. 3 and first heater elements 151*a* as shown in FIG. 5 are operated via the operational pulses shown in FIG. 4 to provide continuous ink jet printing with pixels having the desired graytone levels.

Referring again to FIG. 2, in accordance with the preferred embodiment of the present invention, the second heater elements 51*b* of SIDE 2 of the print head 16 are operated as described in further detail below to generate a deflection correcting electrical pulse to be applied to the second heater element 51*b* to prevent misdirection of ink droplets at the end of a printing operation. The deflection correcting electrical pulse is the HEATER_DATA signal for the second heater elements 51*b* on SIDE 2 of the print head 16, where the HEATER_DATA signal is derived from the ENABLEx and HEAD_DATAx signals and is the output of the AND gate 58*b* shown in FIG. 2.

Figure 6:
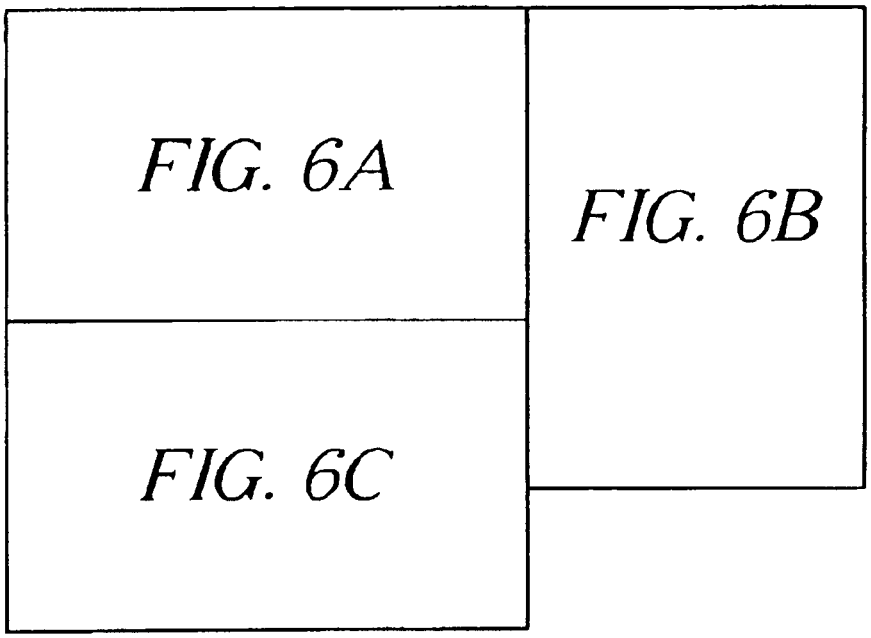
FIG. 6 is an expanded schematic diagram of the print head of FIG. 5 which also show the circuitry of SIDE 2 with the second heater elements and the first line image data provided to the shift register of SIDE 2.
Figure 6B:
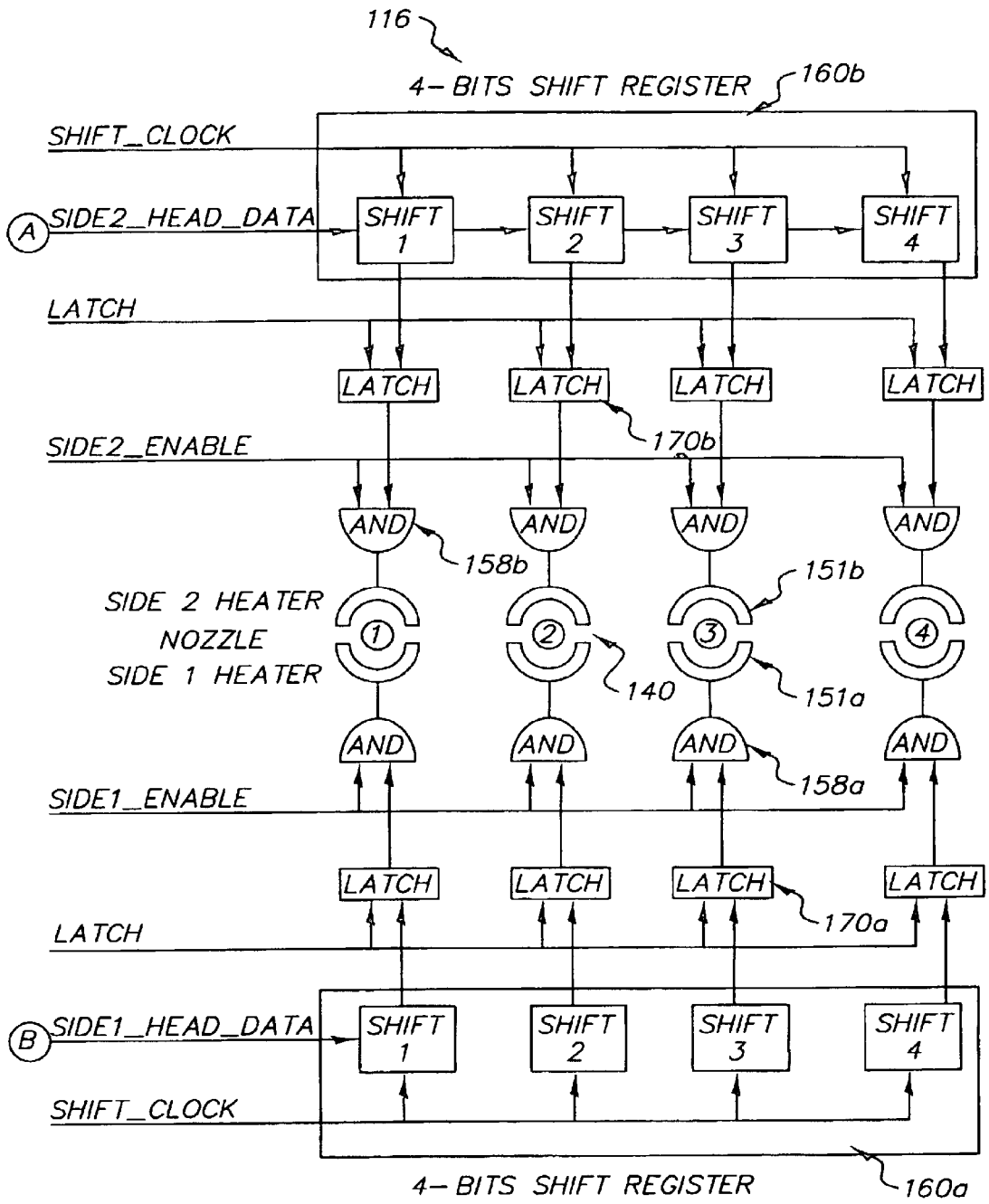

FIG. 6 is an expanded schematic diagram of the print head 116 of FIG. 5 which also show the circuitry of SIDE 2 with the second heater elements 151*b*, the AND gates 158*b*, the latch registers 170*b* and shift register 160*b*. The details of the ENABLE signal that is provided to the AND gates 158*b* of SIDE 2 and its interaction with the generated HEAD_DATA signal is substantially similar to the above described manner. Correspondingly, this aspect is omitted below to avoid repetition. However, the generation and timing of the HEAD_DATA signal for the deflection correcting pulse in accordance with one embodiment of the present invention is described in detail in the context of various examples. In this regard, FIG. 6 further illustrates the first line image data being provided to the shift register 160*b* of SIDE 2, the first line image data being derived in the manner described in further detail herein below.

Figure 7:
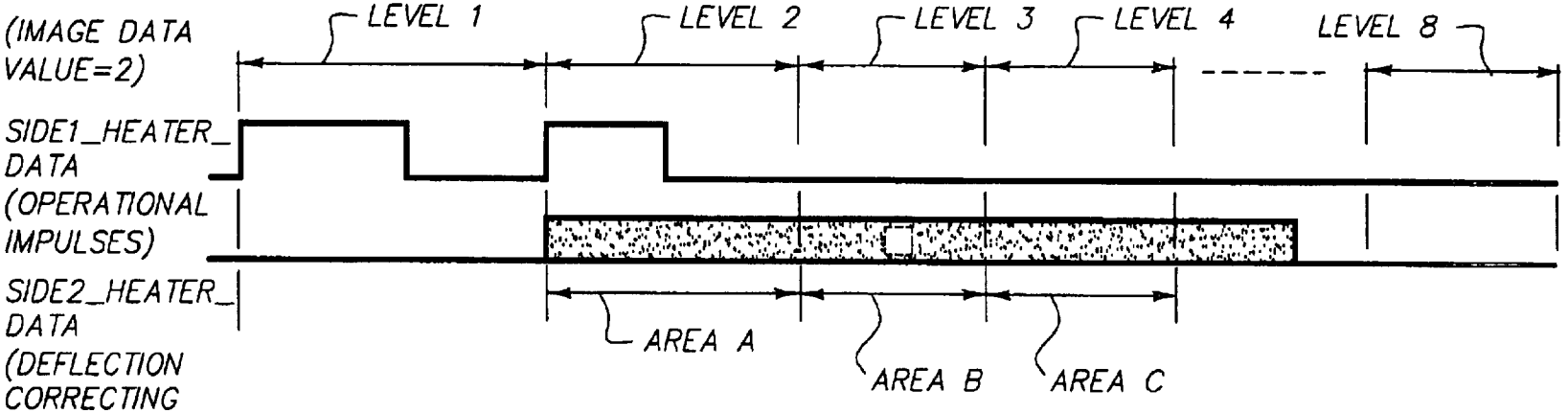
FIG. 7 is a schematic illustration showing the relationship of the SIDE 1_HEATER_DATA which is the operational pulses for the first heater elements, and SIDE 2_HEATER_DATA which is the deflection correcting operational pulses for the second heater elements in accordance with one embodiment.

FIG. 7 shows the relationship of the SIDE 1_HEATER_DATA which is the operational pulses for the first heater elements 151*a*, and SIDE 2_HEATER_DATA which is the deflection correcting pulses for the second heater elements 151*b* in accordance with one embodiment of the present invention. In this regard, as previously described, the operational pulses and deflection correcting pulses are provided when the corresponding ENABLE signal and LATCH signal (derived from HEAD_DATA signal) are provided to the respective AND gates 158*a* and 158*b* which provide the SIDE 1_HEATER_DATA and the SIDE 2_HEATER_DATA to the respective first and second heater elements 151*a* and 151*b*.

The operational pulses as represented by SIDE1_HEATER_DATA provided to the first heater elements 151*a* in FIG. 7 is for the first image data value of 2. The deflection correcting electrical pulse as represented by SIDE2_HEATER_DATA which act to prevent misdirection of ink droplets at the end of a printing operation is preferably provided in the shaded areas of FIG. 7, for example, as shown by the pulse illustrated by dashed lines. The exact placement of the deflection correcting electrical pulse depends on several system parameters such as print head characteristics, the viscosity and thermal properties of the ink, and other thermal and fluid dynamic factors.

As will be evident from the discussion below, the deflection correcting electrical pulse can be generated from the line image data in a manner somewhat similar to the method that was used to generate the operational pulses described above. In this regard, the deflection correcting electrical pulse can be generated by comparing the line image data values to a reference value. However, instead of comparing the line image data values to a reference value in a "greater than" comparison wherein a digital 1 was produced if the line image data was greater than a corresponding reference value (see discussion above relative to TABLE 2 and TABLE 3), the deflection correcting electrical pulse comparison is an "equals" comparison wherein a digital 1 is generated if the image data value is equal to the corresponding reference value and a digital 0 is generated otherwise. This digital 1 generated when the image data value is equal to the corresponding reference value serves as an "actuation value" which times the deflection correcting electrical pulse that actuates the second heater element 151*b* to prevent misdirection of ink droplets at the end of a printing operation. The equals comparison used to determine timing of the deflection correcting electrical pulse produces only one pulse in a given serial bit stream for a given image data value, thus producing only one pulse for a given nozzle during a printing operation. This aspect of the invention is further discussed below and is most clearly shown in FIG. 6 and the TABLES 4 and 5 which are discussed in detail below.

Figure 8:
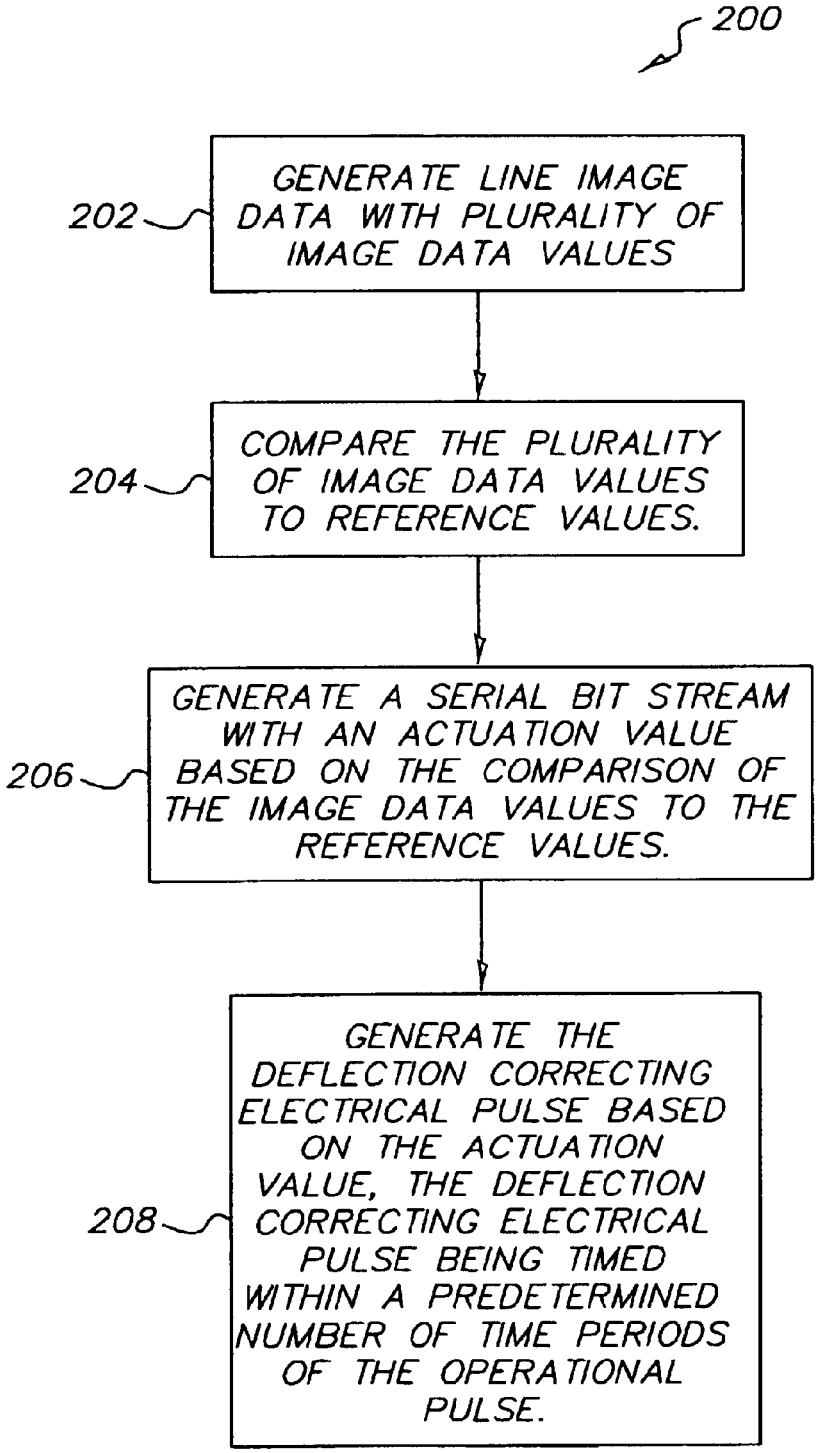
FIG. 8 is a flow diagram illustrating a method for timing a deflection correcting electrical pulse of an asymmetric thermal droplet deflector of a continuous ink jet printer in accordance with one embodiment of the present invention.

FIG. 8 shows flow diagram 200 illustrating the method for timing a deflection correcting electrical pulse relative to an operational pulse of an asymmetric thermal droplet deflector of a continuous ink jet printer in accordance with one embodiment of the present invention. As can be seen, the present method includes step 202 in which line image data with plurality of image data values indicative of desired pixel graytone levels is generated. In step 204, the plurality of image data values are iteratively compared to reference values. As described in the examples herein below, the reference values may be increased in uniform increments in one embodiment, be stored in a look up table, or the like. Based on the comparison of the plurality of image data values to the reference values, a serial bit stream with an actuation value is generated in step 206. Then, the deflection correcting electrical pulse is generated based on the actuation value in step 208, the deflection correcting electrical pulse being timed within a predetermined number of time periods of the last operational pulse. In various embodiments of the invention, the deflection correcting electrical pulse is generated in the same time period of the last operational pulse or in a time period subsequent to the last operational pulse such as one or two time periods subsequent to the last operational pulse.

In the above regard, the timing of the deflection correcting electrical pulse occurrence can be controlled in accordance with one embodiment of the present invention by manipulating the reference values that the image data is to be compared to. In this manner, the method of the present invention offers a flexible and simple method of generating and timing the deflection correcting electrical pulse. Four specific embodiments of the present method are described below.

EXAMPLE 1

Reference Value Starts at 1

Referring again to the previous example shown in FIG. 6, a print head 116 having four nozzles 140 is shown which are used to print the two lines of image data described previously, where the first line image data includes image data values 2, 5, 0, and 1, a total of eight graytones being possible for each pixel. Thus, for the first line image data, the $1^{st}$ nozzle is to print a pixel at graytone level 2 while the $2^{nd}$ nozzle is to print a pixel at graytone level 5, etc. TABLE 4 shows the results of comparing the first line image data (2, 5, 0, 1) to the reference value in accordance with one embodiment of the present method where the reference value begins at 1 and increments to the highest graytone level 7. Again, for the deflection correcting electrical pulses which are provided to the second heater element 151*b* of SIDE 2, the comparison is an "equals" comparison where digital 1 is only produced when the line image data is equal to the reference value, and digital 0 is produced otherwise, the digital 1 being the actuation value which times the deflection correcting electrical pulse for each of the nozzles.

TABLE 4

| First Line Image Data | Reference Values 1 | 2 | 3 | 4 | 5 | 6 | 7 |
|---|---|---|---|---|---|---|---|
| | Comparison Results {= 1 if (Image Data > Reference Value) otherwise = 0} | | | | | | |
| 2 | 0 | 1 | 0 | 0 | 0 | 0 | 0 |
| 5 | 0 | 0 | 0 | 0 | 1 | 0 | 0 |
| 0 | 0 | 0 | 0 | 0 | 0 | 0 | 0 |
| 1 | 1 | 0 | 0 | 0 | 0 | 0 | 0 |
| | First serial bit stream to be shifted | Second serial bit stream to be shifted | Third serial bit stream to be shifted | Fourth serial bit stream to be shifted | Fifth serial bit stream to be shifted | Sixth serial bit stream to be shifted | Seventh serial bit stream to be shifted |

As can be seen by comparing TABLE 4 with TABLE 2 discussed above, only one actuation value is produced per nozzle. In addition, in the present embodiment, the timing of the deflection correcting electrical pulse is effectively concurrent in time with the last operational pulse for a given image data value. In other words, for each of the nozzles, the deflection correcting electrical pulse is timed to occur at the same time period as the last operational pulse of the particular nozzle, each time period being associated with the particular reference value. Thus, with respect to FIG. 7, the deflection correcting electrical pulse is provided to the second heater element 151*b* for the first nozzle in Area A.

Moreover, it should also be evident in the example above, because the reference value is incremented beginning at 1, the total number of iterations of comparing the plurality of image data values of the line image data value with the reference value is one less than the total number of pixel graytones G. Thus, in the present example, the number of iterations is the same as the number of generated operational pulses so that the total number of time increments is not increased, and thus, the speed of the printer system 1 is not adversely effected.

It should also be noted that there is some minor timing adjustment that can be made to the timing of the deflection correcting electrical pulse using the timing and duration of the ENABLE signal. However, such adjustment is constrained to occur within the time period that is reserved for the specific graytone level and a corresponding reference value.

EXAMPLE 2

Reference Value Starts at 0

In accordance with another embodiment of the present method, the timing of the deflection correcting electrical pulse occurrence is effectively shifted in time to occur after the last operational pulse for a given image data value printed by a nozzle by having the reference value begin at 0 and increment to 7. Again, for the deflection correcting electrical pulses, the comparison is an "equals" comparison where the actuation value of digital 1 is only produced when the line image data is equal to the reference value, and digital 0 is produced otherwise. The results of this comparison are shown in TABLE 5.

TABLE 5

| First Line Image Data | Reference Values 0 | 1 | 2 | 3 | 4 | 5 | 6 | 7 |
|---|---|---|---|---|---|---|---|---|
| | Comparison Results {= 1 if (Image Data > Reference Value) otherwise = 0} | | | | | | | |
| 2 | 0 | 0 | 1 | 0 | 0 | 0 | 0 | 0 |
| 5 | 0 | 0 | 0 | 0 | 0 | 1 | 0 | 0 |
| 0 | 1 | 0 | 0 | 0 | 0 | 0 | 0 | 0 |
| 1 | 0 | 1 | 0 | 0 | 0 | 0 | 0 | 0 |
| | First serial bit stream to be shifted | Second serial bit stream to be shifted | Third serial bit stream to be shifted | Fourth serial bit stream to be shifted | Fifth serial bit stream to be shifted | Sixth serial bit stream to be shifted | Seventh serial bit stream to be shifted | Eighth serial bit stream to be shifted |

It should be noted that in Example 1 described above, the "equals" comparison was performed seven times for each line image data using reference values from 1 to 7. In Example 2, the "equals" comparison is performed eight times for each line image data using reference value from 0 to 7. The extra comparison is required so that the deflection correcting electrical pulse for the highest graytone level image data (7 in this example) can be delayed in time to occur after the last operational pulse for each nozzle. Thus, with respect to FIG. 7, the deflection correcting electrical pulse is provided to the second heater element 151*b* for the first nozzle in Area B. Moreover, it should also be evident in the example above, the total number of iterations of comparing the plurality of image data values of the line image data value with the reference value equals the total number of pixel graytones G.

In addition, this comparison method produces a digital 1 in the case where the image data is 0. For instance, as shown in TABLE 5, the first line image data of the 3$^{rd}$ nozzle is 0 so that when the reference value is 0, a digital 1 is produced. However, since image data value of 0 means no ink droplet will be ejected from the nozzle at all, the deflection correction pulse is not required and is not be generated. One way of handling this exception is by modifying the ENABLE signal to produce no pulse for the first deflection correcting electrical pulse serial bit stream. This can be attained in various ways including by loading 0 in a corresponding ENABLE table for the first high segment pulse width as described in the related application entitled METHOD AND APPARATUS FOR CONTROLLING HEATERS IN A CONTINUOUS INK JET PRINT HEAD (Docket 81912) noted previously.

EXAMPLE 3

Reference Value Starts at −1

Although the above described Example 2 allows for delaying the deflection correcting electrical pulse to occur after the last operational pulse, the maximum delay is still limited by the time period that is associated to the next graytone level and reference value. For example, in the present example where the first image data value is 2, the deflection correcting electrical pulse can occur anywhere in the time slot that is reserved for graytone level 2 which can be concurrent with the last operational pulse by using the embodiment of Example 1. This is represented by the Area A in FIG. 7. By using the embodiment of Example 2, the deflection correcting electrical pulse will definitely occur after the last operational pulse, but is constrained to the timing interval that is associated to the next graytone level, which in this example, is graytone level 3. This is represented by the Area B in FIG. 7.

In accordance with another embodiment of the present invention, if longer separation or delay is desired between the last operational pulse and the deflection correcting electrical pulse such that the deflection correcting electrical pulse occurs in Area C of FIG. 7, the reference value may be started at −1. In such a case, a total of nine "equals" comparisons described above between the image data values and the reference value is made for reference values of −1 to 7.

Of course, in yet other embodiments of the present invention, even longer separation may be attained between the last operational pulse and the deflection correcting electrical pulse by starting the reference value at −2, −3, etc. However, such extended delay is not as desirable since such delay can allow misdirection of ink droplets at the end of a printing operation in a continuous ink jet stream and the speed of the printer system 1 is adversely effected since timing intervals are added.

EXAMPLE 4

Reference Value Starts at 0, with Table Look-Up Value

As in Example 3, the present embodiment provides a longer separation or delay between the last operational pulse and the deflection correcting electrical pulse so that the deflection correcting electrical pulse occurs in Area C of FIG. 7. In this case the reference value begins at 0, but the reference values are obtained from a reference look-up table and the reference values may not necessarily increase in uniform steps or increments. The embodiment taught in Example 3 began with a reference value of −2. In that embodiment, the reference values would be −2, −1, 0, 1, 2, 3, etc. In the present embodiment, the reference values used to produce the same printing result would be 0, 0, 0, 1, 2, 3, etc. The reference values would be obtained from a reference look-up table and in the present embodiment, does not increase in uniform steps as shown. As indicated in Example 2, deflection correction pulses would not be required when image data values with value 0 were compared to the 0 reference values. One way of handling these exceptions is by modifying the ENABLE signal to produce no pulse for the first 3 deflection correcting electrical pulse serial bit streams. This can be attained in various ways including by loading 0 in a corresponding ENABLE table for the first 3 high segment pulse widths. The ENABLE table structure is described in the related application entitled METHOD AND APPARATUS FOR CONTROLLING HEATERS IN A CONTINUOUS INK JET PRINT HEAD (Docket 81912) noted previously.

Figure 9:
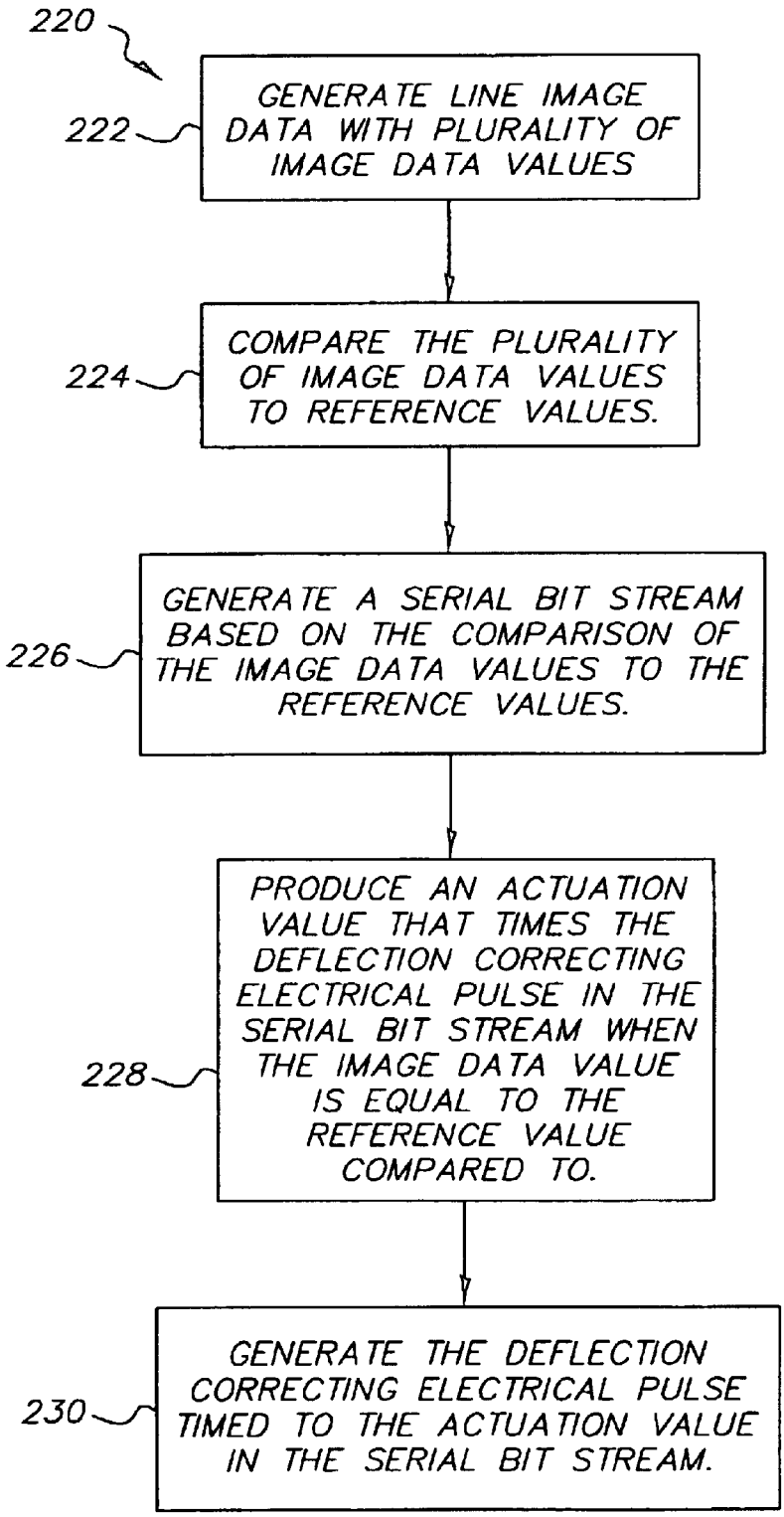
FIG. 9 is a flow diagram illustrating another method for timing a deflection correcting electrical pulse of an asymmetric thermal droplet deflector of a continuous ink jet printer in accordance with another embodiment of the present invention.

The above examples illustrated another aspect of the method for timing a deflection correcting electrical pulse relative to operational pulses of an asymmetric thermal droplet deflector of a continuous ink jet printer having plurality of nozzles as shown in FIG. 9. As can be seen in the flow diagram 220, the method includes step 222 where at least one line image data with plurality of image data values corresponding to the plurality of nozzles is generated, the plurality of image data values being indicative of desired pixel graytone levels for the plurality of nozzles. The plurality of image data values are then compared to reference values in step 224. Again, the reference values may be increased in uniform increments or otherwise, be stored in a look-up table. In step 226, at least one serial bit stream in the form of serially arranged bits is generated based on the comparison of the image data values to the reference values. The actuation value that times the deflection correcting electrical pulse is produced in the serial bit stream in step 228 when the image data value is equal to the reference value compared to. In the embodiment shown, the method further includes step 230 in which the deflection correcting electrical pulse timed to the actuation value in the serial bit stream is actually generated.

As described above, the reference value may be started at 1 so that the deflection correcting electrical pulse is generated concurrently timed with last operational pulses for each of the plurality of nozzles. In other embodiments, the reference value may be started at less than 1 so that the deflection correcting electrical pulse is generated subsequent to last operational pulses for each of the plurality of nozzles. In still other embodiments, the reference values may be stored in a look-up table.

In addition, it should be evident by the various examples above, the total number of iterations of comparing the plurality of image data values of the line image data value with the reference value depends on the total number of pixel graytones and where the reference value starts, for instance, at 0, −1 or −2 etc. Moreover, it should be further noted that whereas in the various examples of the present method described above, the actuation value was a digital 1, in other alternative implementations, the actuation value may be a digital 0 instead where the digital 0 serves to time the deflection correcting electrical pulse for the second heater element.

Lastly, whereas only some of the specific details of hardware such as shift registers, latches, AND gates, etc. were described above, it should be evident to one of ordinary skill in the art in view of the above teachings that additional hardware may be used to implement the present method described above. In particular, various solid state, digital devices and circuits may be used including clocks, counters, random access memory, programmable tables, comparator circuits, pulse generating amplifiers, appropriate software, and/or micro-processors which may reside in one or more of the micro-controller 24, heater control circuits 14, and/or the print head 16 of FIG. 1 discussed above.

In conclusion, it should now be evident that the present invention provides an accurate and efficient method for controlling the timing of the deflection correcting electrical pulse for the second heater element which is used to prevent misdirection of ink droplets at the end of a printing operation. As described above, this is attained by a method of the present invention that generates and places the deflection correcting electrical pulse precisely where needed through the use of the "equals" comparison to a reference value, and by selecting the appropriate value to be used as the reference values.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

PARTS LIST

1 continuous ink jet printer system
10 image source
12 image processing unit
14 heater control circuit
16 printhead
17 ink gutter
18 recording medium
19 ink recycling unit
20 recording medium transport system
22 recording medium transport control system
24 micro-controller
26 ink pressure regulator
28 ink reservoir
30 ink channel device
40 nozzle
42 substrate
46 nozzle bore
50 heater
51*a* first heater element
51*b* second heater element
54 power source
55 ground
56*a* driver transistor
56*b* driver transistor
58*a* AND gate
58*b* AND gate
60*a* shift register
70*a* latch registers
116 print head
140 nozzles
151*a* first heater element

151*b* second heater element
158*a* AND gate
158*b* AND gate
160*a* shift register
160*b* shift register
170*a* latch registers
170*b* latch registers
200 flow diagram
202 step
204 step
206 step
208 step
220 flow diagram
222 step
224 step
226 step
228 step
230 step

What is claimed is:

1. A method for timing a deflection correcting electrical pulse relative to operational pulses of an asymmetric thermal droplet deflector of a continuous ink jet printer having plurality of nozzles, comprising the steps of:

generating at least one line image data with a plurality of image data values corresponding to said plurality of nozzles, said plurality of image data values being indicative of desired pixel graytone levels for said plurality of nozzles;

comparing said plurality of image data values to a reference value;

generating at least one serial bit stream in the form of serially arranged bits based on the comparison of said image data values to said reference value; and producing an actuation value that times the deflection correcting electrical pulse in said serial bit stream when said image data value is equal to said reference value.

2. The method of claim 1, further including the step of generating the deflection correcting electrical pulse timed to the actuation value in said serial bit stream.

3. The method of claim 1, further including the step of iteratively comparing said plurality of image data values of said line image data with said reference value.

4. The method of claim 1, wherein said actuation value produced to time the deflection correcting electrical pulse is a digital 1.

5. The method of claim 1, wherein said reference value increases in uniform increments.

6. The method of claim 5, further including the step of generating the deflection correcting electrical pulse timed to the actuation value in said serial bit stream.

7. The method of claim 5, further including the step of iteratively comparing said plurality of image data values of said line image data with said reference value as said reference value is increased in uniform increments.

8. The method of claim 5, wherein said reference value starts at 1 so that said deflection correcting electrical pulse is generated concurrently timed with last operational pulses for each of said plurality of nozzles.

9. The method of claim 5, wherein said reference value starts at less than 1 so that said deflection correcting electrical pulse is generated subsequent to last operational pulses for each of said plurality of nozzles.

10. The method of claim 9, wherein said reference value starts at 0 so that said deflection correcting electrical pulse is generated one predetermined time period subsequent to last operational pulses for each of said plurality of nozzles.

11. The method of claim 9, wherein said reference value starts at −1 so that said deflection correcting electrical pulse is generated two predetermined time periods subsequent to last operational pulses for each of said plurality of nozzles.

12. The method of claim 9, wherein said reference value starts at −2 so that said deflection correcting electrical pulse is generated three predetermined time periods subsequent to last operational pulses for each of said plurality of nozzles.

13. The method of claim 5, wherein said actuation value produced to time the deflection correcting electrical pulse is a digital 1.

14. The method of claim 5, wherein the total number of iterations of comparing said plurality of image data values of said line image data with said reference value is less than or equal to the total number of pixel graytone levels.

15. The method of claim 5, wherein the total number of iterations of comparing said plurality of image data values of said line image data with said reference value exceeds the total number of pixel graytone levels.

16. The method of claim 1, wherein said reference value is a plurality of reference values stored in a look up table.

17. The method of claim 16, wherein at least first of said plurality of reference values is 0 so that said deflection correcting electrical pulse is generated subsequent to last operational pulses for each of said plurality of nozzles.

18. The method of claim 16, further including the step of iteratively comparing said plurality of image data values of said line image data with said plurality of reference values stored in said look up table.

19. The method of claim 18, wherein the total number of iterations of comparing said plurality of image data values of said line image data with said reference value is less than or equal to the total number of pixel graytone levels.

20. The method of claim 18, wherein the total number of iterations of comparing said plurality of image data values of said line image data with said reference value exceeds the total number of pixel graytone levels.

21. The method of claim 18, further including the step of generating the deflection correcting electrical pulse timed to the actuation value in said serial bit stream.

22. A method for timing a deflection correcting electrical pulse relative to an operational pulse of an asymmetric thermal droplet deflector of a continuous ink jet printer, comprising the steps of:

generating line image data with plurality of image data values indicative of desired pixel graytone levels;

iteratively comparing said plurality of image data values to a reference value at predetermined time periods;

generating a serial bit stream with an actuation value based on the comparison of said plurality of image data values to said reference value; and generating said deflection correcting electrical pulse based on said actuation value, said deflection correcting electrical pulse being timed within a predetermined number of time periods of said operational pulse.

23. The method of claim 22, wherein said deflection correcting electrical pulse is generated in the same time period of said operational pulse.

24. The method of claim 22, wherein said deflection correcting electrical pulse is generated in a time period subsequent to the operational pulse.

25. The method of claim 24, wherein said deflection correcting electrical pulse is generated in one time period subsequent to the operational pulse.

26. The method of claim 24, wherein said deflection correcting electrical pulse is generated in two time periods subsequent to the operational pulse.

27. The method of claim 22, wherein said reference value increases in uniform increments.

28. The method of claim 22, wherein said reference value is a plurality of reference values stored in a look up table.

* * * * *